US007926454B2

(12) United States Patent
Hedman

(10) Patent No.: US 7,926,454 B2
(45) **Date of Patent: *Apr. 19, 2011**

(54) METHOD OF GENERATING PRESSURE PULSES, A PRESSURE PULSE GENERATOR AND A PISTON ENGINE PROVIDED THEREWITH

(75) Inventor: Mats Hedman, Sparreholm (SE)

(73) Assignee: Cargine Engineering AB, Stockholm (SE)

( * ) Notice: Subject to any disclaimer, the term of this patent is extended or adjusted under 35 U.S.C. 154(b) by 1192 days.

This patent is subject to a terminal disclaimer.

(21) Appl. No.: 10/589,507

(22) PCT Filed: Feb. 17, 2005

(86) PCT No.: PCT/SE2005/000212

§ 371 (c)(1),
(2), (4) Date: Aug. 15, 2006

(87) PCT Pub. No.: WO2005/078245

PCT Pub. Date: Aug. 25, 2005

(65) Prior Publication Data

US 2007/0186883 A1 Aug. 16, 2007

(30) Foreign Application Priority Data

Feb. 18, 2004 (SE) ..... 0400390

(51) Int. Cl.
*F01L 9/02* (2006.01)

(52) U.S. Cl. ..... 123/90.12; 123/90.13; 137/625; 251/129.15

(58) Field of Classification Search ..... 123/90.12, 123/90.13, 90.11; 251/129.01, 129.15; 91/392; 137/625, 625.65, 625.69
See application file for complete search history.

(56) References Cited

U.S. PATENT DOCUMENTS 7,472,669 B2 * 1/2009 Hedman ..... 123/90.12

FOREIGN PATENT DOCUMENTS

WO 02/04790 1/2002
WO WO 03102385 12/2003

* cited by examiner

*Primary Examiner* — Ching Chang
(74) *Attorney, Agent, or Firm* — Young & Thompson

(57) ABSTRACT

A pressure pulse generator, including a pressure pulse transmitting body, a chamber, divided into a first and a second part, a first conduit that leads between a high pressure source and the first part of the chamber, a second conduit that leads between a low pressure source and the second part of the chamber, the body being displaceably arranged in the second part of the chamber and being in contact with a pressure fluid in the chamber, and with the environment and being spring loaded in a direction towards the chamber. The pressure pulse generator includes elements for opening/interrupting the communication between the first part of the chamber and the high pressure source, and elements for opening/interrupting the communication between the second part of the chamber and the low pressure source, and an operable valve body for opening/interrupting the communication between the first and second parts of the chamber.

22 Claims, 7 Drawing Sheets

METHOD OF GENERATING PRESSURE PULSES, A PRESSURE PULSE GENERATOR AND A PISTON ENGINE PROVIDED THEREWITH

TECHNICAL FIELD

The present invention relates to a method of generating pressure pulses in accordance with the below disclosure.

The invention also relates to a pressure pulse generator, and a piston engine provided therewith.

The pressure pulses generated by a fluid that is permitted to flow in a circuit in the pressure pulse generator are suitably used for controlling and operating an inlet or outlet valve to the combustion chamber of a combustion engine. The pressure pulse transmitting body may then be an integrated part of such a valve, preferably the valve stem in the case when the pressure fluid is a liquid, or a piston connected with the valve stem and driven in a cylinder, in case that pressure fluid is a gas. Alternatively, said body may be separate and arranged to act against an existing valve stem. The pressure pulse generator and the method of controlling the latter can be used for the purpose of controlling the height of lift of the valves, i.e. how much the valves are to open, and the opening times of the valves, i.e. the crank angle grade at which the opening and closure thereof is to take place.

Pressure pulses that are generated by means of a pressure pulse generator may also be used for the purpose of controlling the movements of a piston, a VCR-piston (VCR=Variable Combustion Ratio), for the variation of the cylinder volume of a combustion chamber, and, accordingly, the compression ratio, of a combustion engine. If the pressure fluid is a liquid, the pressure pulse transmitting body is, suitably, a stem that acts against or is connected with such a piston, said piston then being displaceably arranged back and forth in a cylinder connected with the combustion chamber. If the pressure fluid is a gas, it can be permitted to act directly against the piston on a side thereof opposite to the one that is directed towards the combustion chamber. The spring load that acts on the pressure pulse transmitting body in a direction towards the chamber of the pressure pulse generator may then be a direct result of the gas pressure that exists in said cylinder, and the combustion chamber, or may, but need not, be accomplished by means of a physical spring.

Suitably, the pressure pulse generator comprises a control unit that, electronically, and based on the position of the pressure pulse transmitting body or the position of a piston in a piston engine (crank angle grade), controls valves for the regulation of the flow of the pressure fluid and, thereby, the initiating of the pressure pulses.

"Chamber", as used in this application, is referred to as a space in which the pressure fluid is accommodated and should be regarded in a wide since. In the application, a chamber is said to be divided into a first and a second part. Of course, it is also possible to regard such unit as consisting of two separate chambers or spaces divided by a channel. The meaning is, however, the same.

"Conduct", as it is used in this application, should also be regarded in a wide sense, and may, accordingly comprise a tubular conduit or a conduit formed by a channel arranged in a piece of material.

THE BACKGROUND OF THE INVENTION

It is widely known to drive spring loaded poppet valves of combustion engines, hereinafter named engine valves, by means of a hydraulic pressure pulse generator. For example, U.S. Pat. No. 6,067,946 discloses the opening of an engine valve by an application of a hydraulic pressure onto a piston that is connected to the valve. The hydraulic pressure either comes from a high pressure source or a low pressure source. The application of the hydraulic pressure is performed by means of a pressure control device based upon signals that are received from an electronic control member. The hydraulic pressure is applied in such a way as to minimize the energy that is required for the activation of the valve while, at the same time, the inertia of the valve is taken ad vantage of. The described system comprises means for opening/interrupting the communication between the high pressure source and the chamber in which the piston is arranged, and means for opening/interrupting the communication between the low pressure source and said chamber.

The method disclosed in U.S. Pat. No. 6,067,946 includes that the high pressure source is brought in the communication with the chamber while the valve is displaced in a direction out of the chamber, i.e. to the opening position of the valve. When the valve gets close to a maximally open position, the communication between the chamber and the high pressure source is interrupted and, instead, a communication between the chamber and the low pressure source is opened. In that way, a braking of the valve is accomplished before it reaches its end position. When the valve has reached this position, it can be locked in that position by interrupting both of said communications. When the valve is to return to its closed position, the communication between the low pressure source and the chamber is re-opened, whereby the pre-loaded spring force displaces the piston into the chamber. When the valve is close to its closed position, the home position, the communication between the high pressure source and the chamber is opened and the communication between the low pressure source and the chamber is interrupted. In that way, a braking of the movement in this direction is achieved. When the valve has reached its home position both communications may be interrupted to keep the valve in this position. In this way, the time during which the valve is open is controlled.

The drawback of this prior art is that the hydraulic liquid which comes from the high pressure source and is used for the projection of the valve to the open position thereof is almost completely further conducted to the low pressure source, whereby there is a significant loss of energy.

THE OBJECT OF THE INVENTION

It is an object of the present invention to provide a method and a pressure pulse generator that makes it possible to minimize the losses of energy in connection to a pressure pulse generation, in particular in connection to a displacement of an engine valve of a combustion engine between the open and closed positions thereof, or a displacement of a VCR-piston.

It is a further object of the invention to achieve the primary object by means of a pressure pulse generator construction, which is as uncomplicated and reliable as possible.

SUMMARY OF THE INVENTION

The primary object of the invention is achieved by the initially defined method, characterized in that the communication between the high pressure source and the first part of the chamber and the communication between the low pressure source and the second part of the chamber are kept interrupted while the communication between the first and second parts of the chamber is opened and a displacement of the body out of the chamber is accomplished, and the communication between the first and second parts of the chamber is kept open for a re-establishment of a high pressure in the first part of the chamber while the body, by the spring load, is displaced back towards a retracted start position while the communication between the high pressure source and the first part of the chamber and the communication between the low pressure source and the second part of the chamber are kept interrupted.

When said body is on its way back to or is already back in its maximally retracted position, the communication between the two parts of the chamber is interrupted and the communication between the first part of the chamber and the high pressure source is opened in order to fully re-establish the pressure in the first part of the chamber.

In other words, the pressure fluid present in the first part of the chamber will act as a pressure fluid spring that, repeatedly, is pre loaded as the body is returned to the start position and when the communication between the two parts of the chamber is interrupted, which, suitably, takes place when the pressure pulse transmitting body is on its way to a home position, that is the position in which it is maximally retracted into the chamber. In the preferred case when the body in question acts against or is connected with a valve stem or a piston connected with the valve of an engine valve, this position corresponds to the home position of the valve, i.e. the closed position.

In particular when the pressure fluid is relatively incompressible, such as a liquid, and when the pressure pulse transmitting body is a stem, for example a valve stem, the communication between the first and second parts of the chamber is interrupted and the communication between the high pressure source and the first part of the chamber as well as the communication between the low pressure source and the second part of the chamber are kept interrupted when, or at least in connection to when, said body reaches a maximally projected position. Thereby, a locking of said body in this position is accomplished. In the case of an engine valve, the time during which the valve is open is controlled in this way. The communication between the first and second parts of the chamber is then opened when the pressure pulse generating body shall be permitted to return to its starting position, or its maximally retracted position. The spring force that acts on the body in a direction towards the chamber and that has been built up during the displacement of the body to the projected position will thereby overcome the force that the hydraulic liquid in the chamber exerts on the body, resulting in a rapid return of the body.

However, a certain amount of energy has been lost during the displacement described above, and the spring force will not be sufficient for a total return of the body. In order to permit such a total return, the method according to the invention includes that the communication between the low pressure source and the second part of the chamber is opened and is kept opened during a final stage of the return movement of said body into the chamber, in order to permit the body to return to a maximally retracted starting position.

Preferably, the pressure pulse transmitting body is connected to a spring loaded inlet or outlet valve or a VCR-piston, of a combustion engine, and, preferably, the height of lift of the valve, or the length of the stroke of the piston is controlled by a control of the pressure that is provided in the first part of the chamber through the high pressure source.

The time during which the spring loaded inlet or outlet valve is kept in an open position is thereby controlled by a control of the time during which the communication between the first and second part of the chamber is kept interrupted when said body is in its maximally projected position. This is particularly relevant when the pressure fluid is a liquid.

The primary object of the invention is also achieved by means of a pressure pulse generator according to the invention, characterized in that it comprises means for opening/interrupting the communication between the first part of the chamber and the high pressure source, and means for opening/interrupting the communication between the second part of the chamber and the low pressure source, and an operable valve body for opening/interrupting the communication between the first and second parts of the chamber. Thanks to the presence of these means for opening and interrupting said communications it is possible to perform the steps of the method according to the invention. The invention permits a preloading of the first part of the chamber and a full return of the pressure pulse transmitting body to its starting position.

According to a preferred embodiment, the means for opening/interrupting the communication between the first part of the chamber and the high pressure source are electromechanically operated. It is particularly preferred that the means for an electro-mechanically operated opening/interrupting of the communication between the first part of the chamber and the high pressure source comprises a solenoid-activated valve body. Also the means for opening/interrupting the communication between the second part of the chamber and the low pressure source has this feature. In that way, a computer program-controlled activation of any present valve body can be performed, and a very precise control of the pressure pulses is achieved.

According to a preferred embodiment of the invention, the operable valve body that is used for opening/interrupting the communication between the first and second parts of the chamber also constitutes a valve body of the means for opening/interrupting the communication between the first part of the chamber and the high pressure source. In this way the amount of components required for the pressure pulse regulation is reduced.

According to another preferred embodiment, the operable valve body that is used for opening/interrupting the communication between the first and second parts of the chamber also constitutes a valve body of the means for opening/interrupting the communication between the second part of the chamber and the low pressure source. This further contributes to the reduction of the number of components that are required for the pressure pulse regulation. In the case in which the valve body is a slide valve, the invention includes that the conduits between the chamber and the high pressure source and the low pressure source respectively are positioned such that they are intersected by the slide valve, and such that the slide valve also intersects a connection between the first and second parts of the chamber, and thus can be used for opening/interrupting the communications in each of these conduits-connections.

As an alternative or supplement to the means that have been mentioned above for opening/interrupting the communication in the conduit to the high pressure source, the means for opening/interrupting the communication between the first part of the chamber and the high pressure source may comprise a portion with a reduced circumference or include an opening in the pressure pulse transmitting body, said portion being positioned in order to open for a communication when said body is close to or in a starting position in which it is maximally retracted into the chamber.

In a corresponding way, said means for opening/interrupting the communication between the second part of the chamber and the low pressure source may comprise a portion with a reduced circumference or an opening in the pressure pulse transmitting body, said portion being positioned for the purpose of opening for a communication when said body is close to a starting position in which it is maximally retracted into the chamber. However, it is important that this communication is once again interrupted when the starting position has been reached, in order to prevent high pressure liquid from draining out that way when the communication between the two parts of the chamber is re-opened upon the starting of the following projection movement. The pressure pulse transmitting body intersects the conduits between the chambers and the high pressure source and the low pressure source respectively.

It should be realized that the first part of the chamber has a volume that is adapted in order to enable the highly pressurized liquid gathered therein to act as a liquid spring, the triggering of which causes a displacement of the pressure pulse transmitting body from a maximally retracted position to a projected position against the spring load that acts on said body in the opposite direction. Said spring load may be the effect of a valve spring of a poppet valve of a combustion engine.

Alternatively, if the pressure fluid is a gas, it should act against a larger area on the pressure pulse transmitting body then what is normally possible if the latter is a valve stem. In such case, the pressure pulse transmitting body is preferably constituted by a piston that is arranged movably back and forth in a cylinder and, for example, connected with or provided in a force transmitting contact with the valve in question. The body may also constitute the piston itself of a VCR-piston. The gas acts directly against the end surfaces of the piston. Moreover, the volume of the first part of the chamber is dimensioned in order to enable a high pressure gas gathered thereinto act as a gas spring, the triggering of which causes a displacement of the pressure pulse transmitting body from a maximally retracted position to a projected position against the spring load that acts on said body in an opposite direction.

Preferably, the pressure pulse generator comprises a control unit with a computer program for controlling the means for opening/interrupting the communication between the first and second parts of the chamber and between the first part of the chamber and the high pressure source and between the second part of the chamber and the low pressure source in accordance with the inventive method, based on an information about the position of the pressure pulse transmitting body or a body connected therewith, and/or based on an information about the position of a piston that operates in the combustion chamber of a piston engine.

The invention also relates to a piston engine with a valve for an introduction or a discharge of air or an air/fuel mixture to a combustion chamber, characterized in that it comprises a pressure pulse generator according to the invention for the operation of said valve.

The invention also relates to a piston engine with a VCR-piston connected to a combustion chamber of the engine, characterized in that it comprises a pressure pulse generator according to the invention for operating said VCR-piston.

Further features and advantages of the invention will be disclosed in the following, detailed description.

BRIEF DESCRIPTION OF THE DRAWINGS

Hereinafter, the invention will be described by way of example with reference to the annexed drawings, on which.

DETAILED DESCRIPTION OF THE INVENTION

Figure 1:
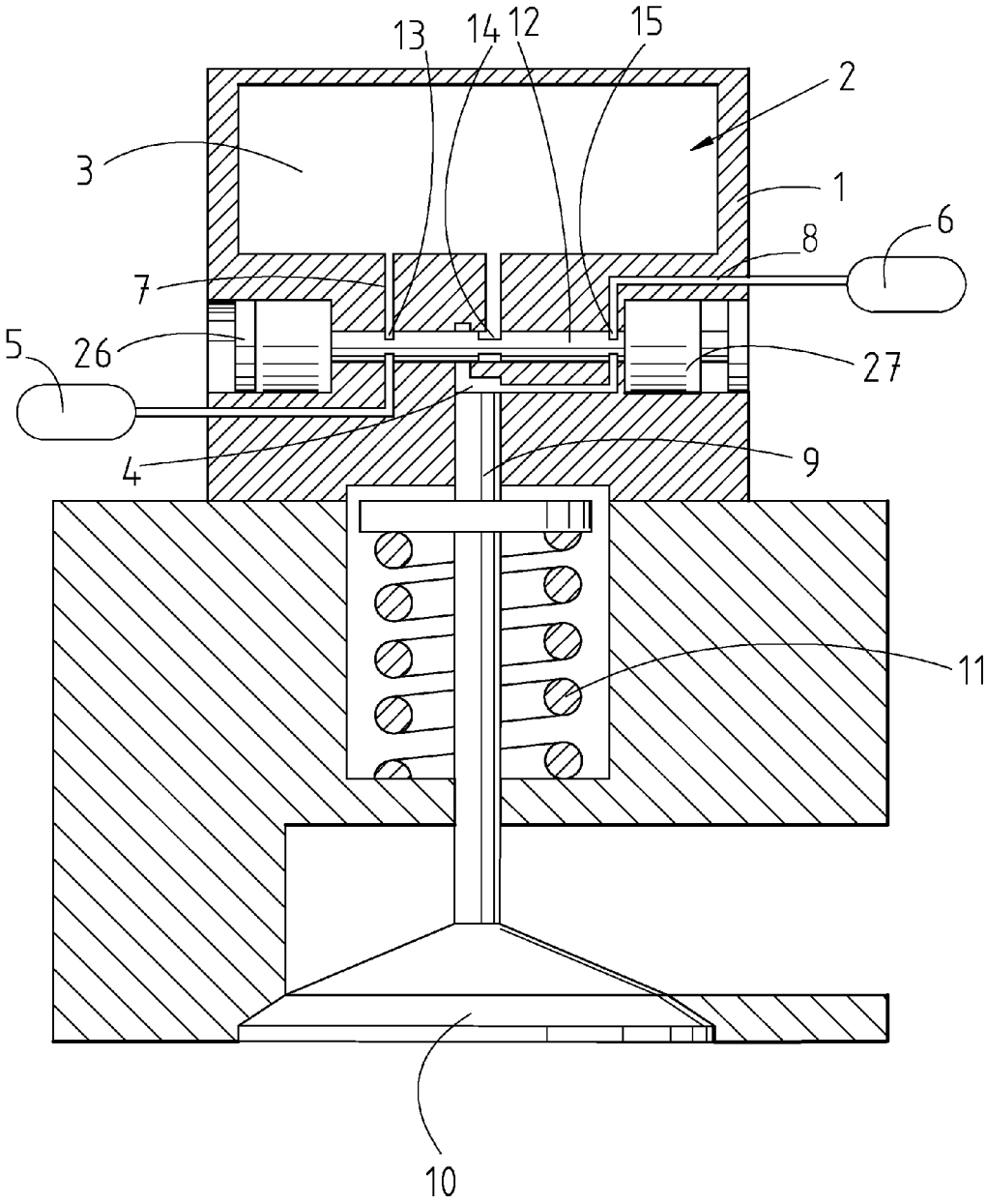
FIG. 1 is a schematic cross section of a pressure pulse generator according to a first embodiment of the invention.

FIG. 1 shows a first embodiment of pressure pulse generator according to the invention. The pressure pulse generator comprises a body 1 that encloses a chamber 2, which, in its turn, can be regarded as divided into a first part 3 and a second part 4. The first part 3 has a larger volume than the second part 4, the volume of which, however, is depending on the position of a pressure pulse transmitting body, as will be described later. Further, the pressure pulse generator comprises a high pressure source 5, a low pressure source 6, a first conduit 7 that connects the high pressure source 5 with the first part 3 of the chamber 2, and a second conduit 8 that connects the low pressure source 6 with the second part 4 of the chamber 2. The high pressure source 5 delivers and the low pressure source 6 receives a hydraulic liquid, for example oil. The high pressure source may be driven by a pump, and the low pressure source 6 may be connected with the atmosphere and may present atmospheric pressure. The low pressure source 6 is, for example, the oil trough of a car or any other vehicle provided with a combustion engine.

Further, the pressure pulse generator comprises a pressure pulse transmitting body 9 that, through an opening in the body 1, is in a direct contact with and projects into the second part 4 of the chamber 2. The pressure pulse transmitting body 9 is displaceably arranged to and from the second part 4 of the chamber 2 and constitutes a part of a wall thereof. In this case, it constitutes a part of or is connected with or bears against a valve stem of an inlet or a outlet valve 10, here a poppet valve, to the combustion chamber (not shown) of a combustion engine. The valve 10 is preloaded into a closed position by means of a spring 11, which accordingly, acts with a force in a direction towards the chamber 2, that is for the purpose of retracting the pressure pulse generating body 9 into the chamber 2. In its closed position, the valve 10 rests against a valve seat, for example in the inner ceiling of the combustion chamber.

Apart from these components, the pressure pulse generator comprises a valve body 12, a first solenoid 26 and a second solenoid 27. The solenoids 26, 27 are arranged for the purpose of activating, in other words displacing, the valve body 12, the task of which is to open or brake the communication between the first part 3 and second part 4 of the chamber 2, between the first part 3 of the chamber 2 and the high pressure source and between the second part 4 of the chamber 2 and the low pressure source 6. This is possible since the valve body 12 runs tightly in a groove in which the path of the valve body intersects a channel that connects the two parts 3 and 4 of the chamber 2, and also intersects the conduits 7, 8 that connects the two parts 3, 4 of the chamber 2 with the high pressure source 5 and the low pressure source 6 respectively. The valve body 12 is provided with taperings or openings 13, 14, 15 that, when they reach a position opposite to a channel or a conduit 7, 8, permit a passage of hydraulic liquid therethrough. By a suitable positioning and extension of such taperings/openings 13, 14, 15 along the valve body 12, a control of the time for opening and interrupting the communication in the respective conduits 7, 8 and between the first part 3 and the second part 4 of the chamber 2 may be accomplished. In FIG. 1, the engine valve 10 is shown in a closed position, in which the pressure pulse transmitting body, in connection with a valve stem, is maximally retracted into the second part 4 of the chamber 2. The taperings/openings 13, 14, 15 are in such positions that the communication between the first part 3 and second part 4 of the chamber 2 is interrupted, while the communications between the first part 3 of the chamber 2 and the high pressure source 5 and between the second part 4 and the low pressure source 6 are open.

The first part 3 of the chamber 2 is designed and dimensioned in order to act as a liquid spring that is loaded or preloaded by a hydraulic liquid of a given pressure, in the position shown in FIG. 1, in order to then be triggered in connection to an opening or closing movement of the engine valve 10, and in order to then, when the closed position once again has been reached be reloaded. The opening-closing cycle according to the invention will be described more in detail, step for step, later.

Figure 2:
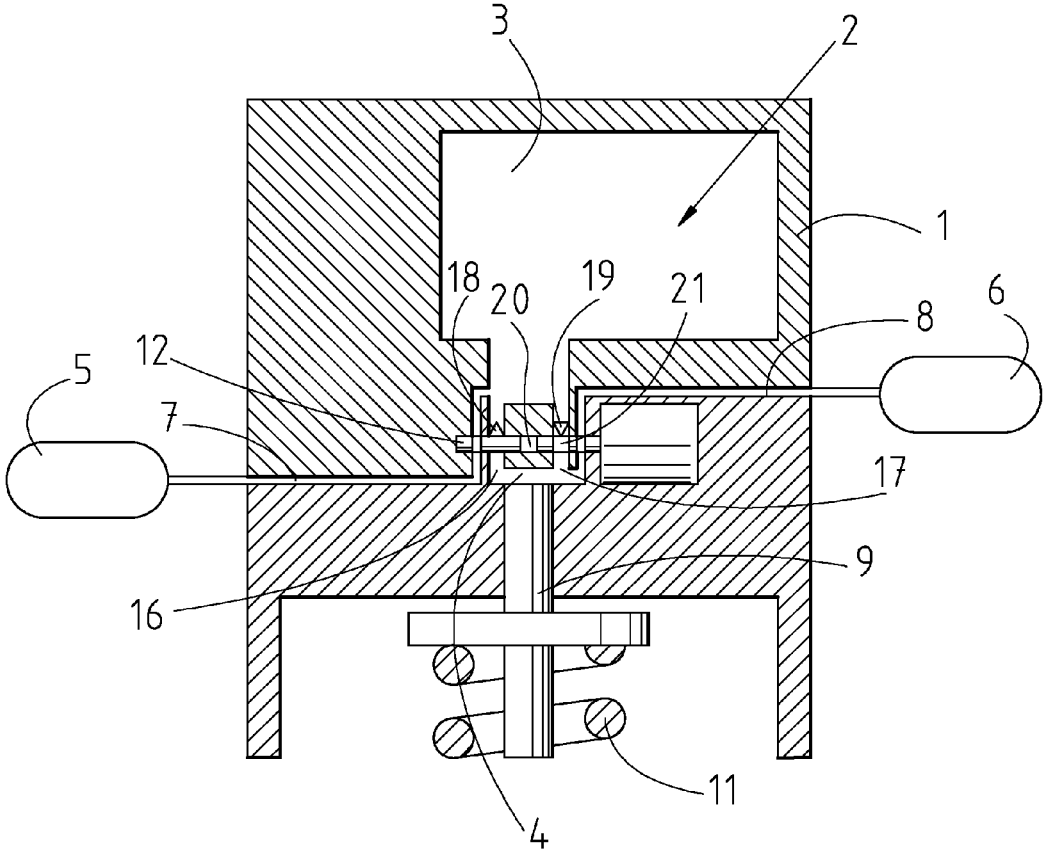
FIG. 2 shows a second embodiment of the pressure pulse generator according to the invention.

FIG. 2 shows an alternative embodiment of the pressure pulse generator. The most remarkable difference compared to the first embodiment is that, instead of only one passage, it comprises a first passage 16 and a second passage 17 between the first part 3 and second part 4 of the chamber 2, and that each passage is provided with a non-return valve 18, 19, said non-return valves 18, 19 being arranged to open in different directions. Moreover, the valve body 12 has two taperings/openings 20, 21, a first one of which 20 is to be positioned opposite to the first passage 17 in a first position of the valve body 12 and the second one of which 21 is to be positioned opposite to the second passage in a second position of the valve body 12. Of course, it is possible to imagine a solution that only has one tapering/opening that is moved between the positions of the non-return valves. The first position corresponds to when the pressure pulse transmitting body 9 is projected and there is to be a flow from the first part 3 of the chamber to the second part 4 thereof, and the second position corresponds to when the body is being retracted or is already retracted and when a flow is to take place or at least be permitted to take place from a second part 4 of the chamber to the first part 3 thereof. The solution has the advantage that the movements of the valve body 12 need not be as precise as in the first embodiment. On the other hand, it has the disadvantage of requiring more components, primarily the non-return valves 18, 19.

Figure 3:
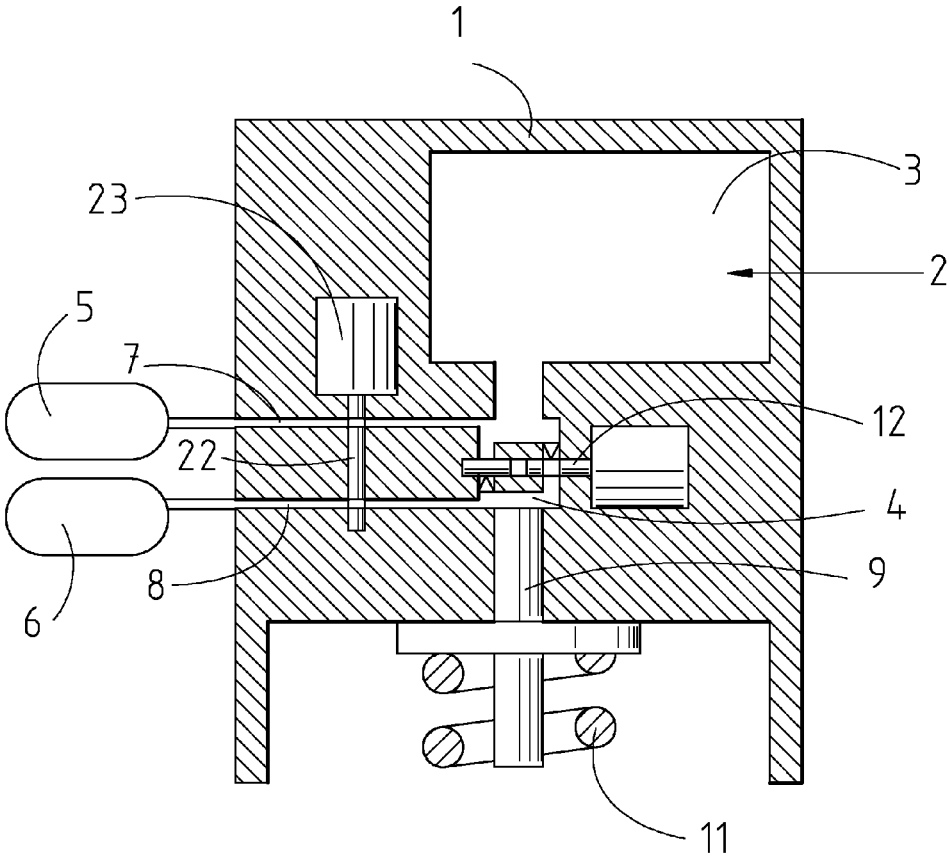
FIG. 3 shows a third embodiment of the pressure pulse generator according to the invention.

FIG. 3 shows another alternative embodiment of the pressure pulse generator according to the invention. The difference when compared to the embodiment shown in FIGS. 1 and 2 is that it comprises a separate valve body 22, which is arranged for opening and interrupting the communication in the conduits 7 and 8 that connects the first part 3 of the chamber with the high pressure source 5 and which connects the second part 4 with the low pressure source 6 respectively. Moreover, it comprises a separate solenoid 23 for the activation of said valve body 22. This solution requires a synchronized control of all solenoids, but also permits better possibilities for a variable control of the opening/interrupting of the communication in the individual conduits/passages independently of each other. A further development could comprise separately operated valve bodies for opening/interrupting the communication in the first conduit 7 and in the second conduit 8.

Figure 4:
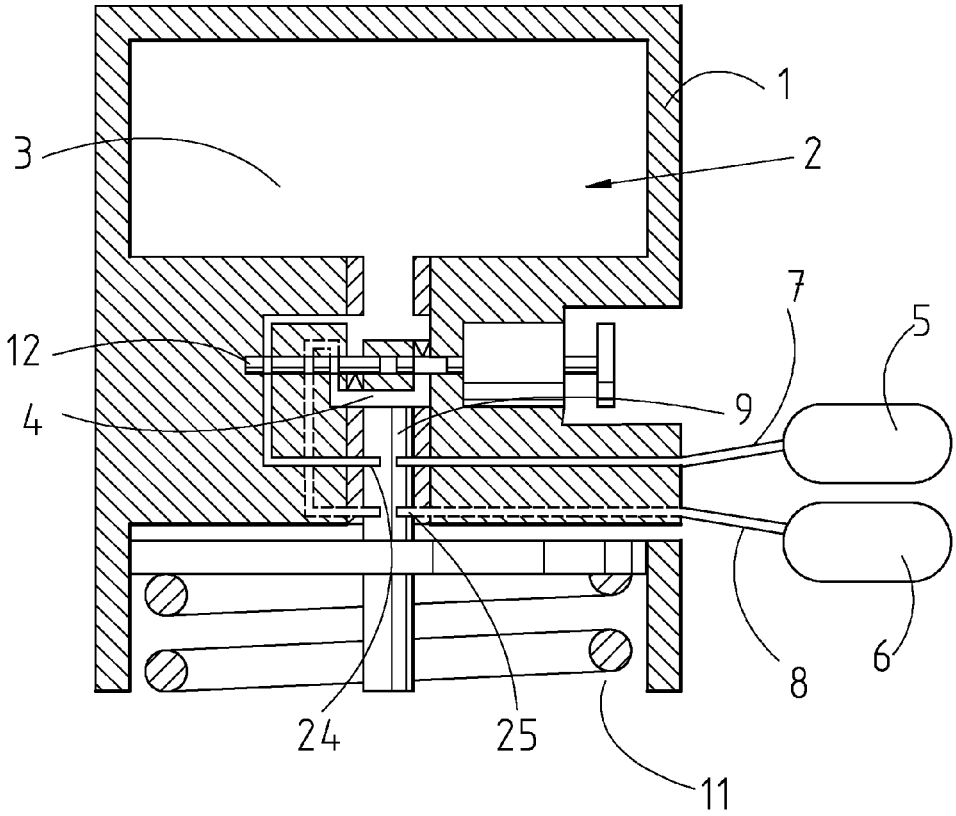
FIG. 4 shows a fourth embodiment of the pressure pulse according to the invention.

FIG. 4 shows another embodiment in which the means for opening and interrupting the communication in the conduits 7, 8 to the high pressure source 5 and to the low pressure source 6 respectively also include the pressure pulse transmitting body 9 itself, wherein said body, at predetermined positions along its longitudinal axis, presents taperings or openings 24, 25, which, when said body 9 reaches a predetermined position, here corresponding to the closed position of the engine valve 10, are located opposite to the conduits 7, 8 and, accordingly, opens for a communication therein. This arrangement guarantees that there will be no communication between the high pressure source 5 and the first part 3 of the chamber 2 or between the low pressure source 6 and second part 4 of the chamber in other cases than in the closed position of the engine valve 10, in other words in the maximally retracted position of the pressure pulse transmitting body 9 or very close to this position.

Figure 5:
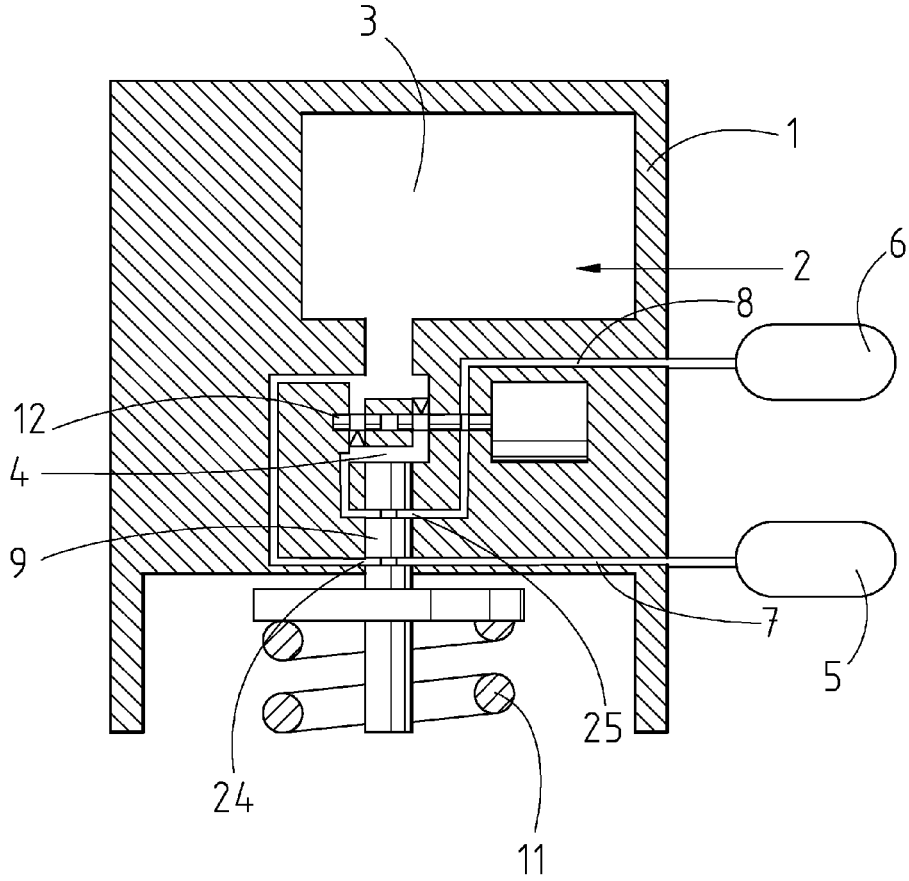
FIG. 5 shows a fifth embodiment of the pressure pulse generator according to the invention.

FIG. 5 shows an embodiment that could be regarded as a simplified further development of the embodiment according to FIG. 4 in the sense that the valve body 12 now is only arranged for the purpose for opening and interrupting the communication between the first part 3 and second part 4 of the chamber, while the taperings/openings 24, 25 of the pressure pulse transmitting body 9 constitute the only means for opening the communication between the high pressure source 5 and the first part 3 of the chamber 2 and between the low pressure source 6 and the second part of the chamber 2 respectively.

Now, an opening-closing cycle of the engine valve 10 will be described more in detail. In a starting position, in which the engine valve 10 is closed and rests against its seat, the valve body 12 for opening/interrupting the communication between the two parts of the chamber 2 is in an interrupting position, while, simultaneously, it permits a communication in the two conduits 7, 8. The communication in the conduit 7 may, in principal, also be interrupted as soon as a desired pressure, corresponding to the pressure of the high pressure source 5, is established in the first part of the chamber 2. In a corresponding way, the communication in the second conduit 8 may be interrupted as soon as the engine valve has reached its closed position, since there is then no longer any need of a continued communication between the low pressure source and the chamber.

When the engine valve 10 is to be opened, one of the solenoids 26, 27 is activated as an answer to a signal from a control unit (not shown), which, suitably, is provided with a computer program for controlling the engine valve 10. When the solenoid 26 or 27 is activated, it displaces the valve body 12 to a position in which a tapering or opening 14 thereof opens for a communication between the first and second part 3, 4 of the chamber, for permitting a flow in a direction towards the second part. Simultaneously, or preferably just before this communication has been established, the communication in the conduits 7, 8 is interrupted for the purpose of preventing any hydraulic liquid from passing directly from the high pressure side to the low pressure side without being taken advantage of for the purpose of displacing the pressure pulse transmitting body 9. The correlation of the timing is achieved through a suitable positioning of the taperings/openings 13, 14, 15. The pressure present in the first part 3 of the chamber 2, that acts as a liquid spring, is adapted in order to permit a predetermined displacement of the engine valve 10 to an open position when the communication between the two parts of the chamber 2 is opened.

When the engine valve 10 has reached a maximally open position, in which the major part of the energy that was stored in the liquid spring now has been used for biasing the valve spring 11, the movement of the engine valve 10 ceases. Thereby, a continued displacement of the valve body 12 takes place until the latter has reached a position in which it brakes the communication between the two parts 3, 4 of the chamber and in which it also brakes the communication in the conduits 7, 8 to the high pressure source 5 and the low pressure source 6 respectively. In that way, a locking of the engine valve in an open position and during an optional time period can be achieved. In the case when non-return valves are used for the regulation of the flow between the parts of chamber, such as shown in FIGS. 2 and 3, one of the non-return valves will guarantee that there is no returning flow when the tapering/opening is in a position opposite to the relevant passage between the first part and the second part provided with this non-return valve. In such a case, the tapering/opening need not be displaced further beyond the passage in order to cause a locking.

When the engine valve is to be re-closed, one of the solenoids 26, 27 is activated for displacing the valve body to an open position, in which it once again opens for communication between the first part 3 and second part 4 of the chamber 2 for a flow in a direction towards the first part 3. The communication in the conduits 7, 8 is still interrupted. The valve engine 10 will perform a returning movement back to the closed position. Since there will always be a certain loss of energy, the energy that is now stored in the preloaded valve spring 11 is, however, not sufficient for permitting a full retraction of the engine valve 10 to its closed position. In order to enable a complete return, it is required that the communication between the chamber 2 and the low pressure source 6 is opened any time during the returning movement. Suitably, this is accomplished by a further displacement of the valve body 12 to a position in which a tapering or an opening 15 thereof will be opposite to the conduit 8 that leads to the low pressure source 6. Just before this moment, simultaneously therewith, or just after this moment, the communication between the two parts of the chamber 2 is to be interrupted, and then the communication between the first part 3 of the chamber 2 and the high pressure source 5 can be re-opened. We are then back in the starting position shown in FIG. 1. Generally, any short circuit i.e. an opening of all communications at the same time, should be avoided as far as possible. In the case when non-return valves are used, such as shown in FIGS. 2 and 3, these, or more precisely one of these, can guarantee that there will be no short circuit.

It should be realized that the delay between the opening and interrupting of the different communications either can be accomplished by means of purely geometrical positionings and choices of dimensions of the present taperings and openings of the relevant valve bodies. In the case when different valve bodies, driven by different solenoids, are used for the opening/interrupting of different communication conduits or passage, the time control can be performed through the computer program that controls the activation of the solenoids for the purposes of achieving a required synchronizing of the timing for opening/interrupting in accordance with the inventive method.

The maximum opening of the engine valve 10, the height of lift, can be controlled during operation through a variation of the pressure in the high pressure source 5, for example through a control of a pump that generates said pressure. It is also conceivable to achieve such a variation if the chamber 2, preferably the first part 3 thereof, is de signed with a variable volume.

The valve time, i.e. the time during which the engine valve 10 is in its maximally open position, can be controlled in a completely computerized way by controlling the time at which the solenoid 26, 27 that operates the valve body 12 for opening and interrupting the communication between the two parts 3, 4 of the chamber is to be activated for a re-opening of this communication.

It should be realised that the invention, as described above for the case in which the used pressure fluid is a liquid, is also applicable to corresponding embodiments in which the pressure fluid is a gas. The substantial differences are then that the gas, due to its higher compressibility, needs to act on a larger area of the pressure pulse transmitting body in order to generate a corresponding movement thereof, and that the volume of the first part of the chamber should be adapted to the fact that the pressure fluid is a gas. Suitably, the pressure pulse transmitting body is then a piston arranged to move back and forth in a cylinder and force-transmittingly connected with the valve the motions of which it is supposed to cause. The pressure pulse transmitting body may also be identical with a VCR-piston that, through said cylinder, is in a direct connection with the combustion chamber of a combustion engine, for the purpose of varying the volume of the latter depending on the engine load.

Figure 6:
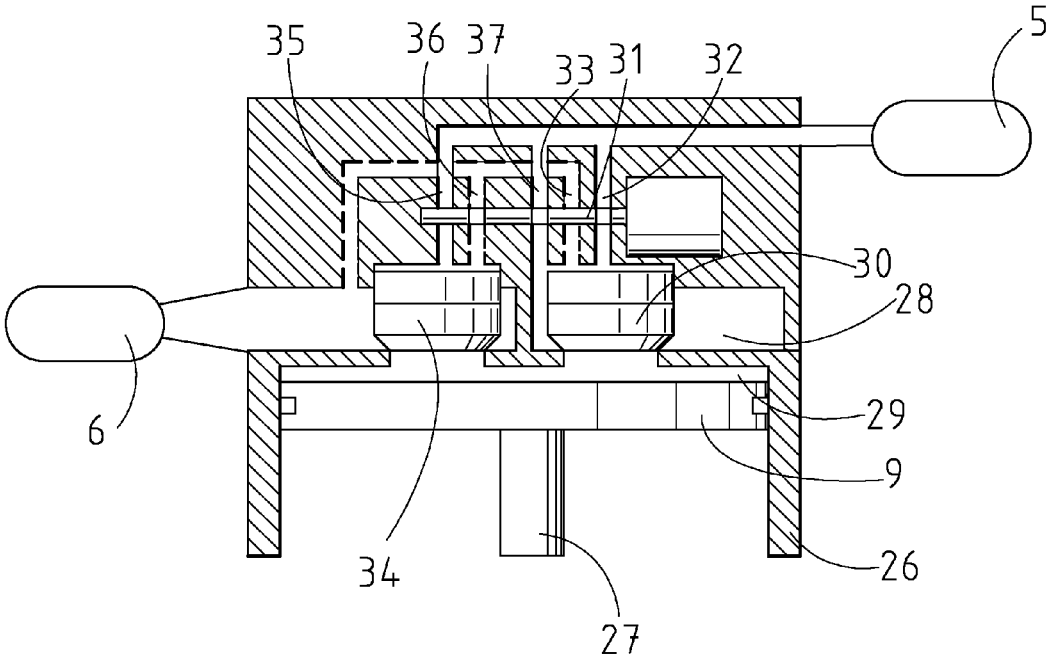
FIG. 6 shows a sixth embodiment of the pressure pulse generator according to the invention.

FIG. 6 shows a further embodiment of the device according 1D the invention, according to which the pressure fluid is a gas and the pressure pulse transmitting body 9 is a piston that is arranged to move back and forth in a cylinder 26 in a gas-sealed way. The piston 9 is directly connected with a stem 27 of a valve (not shown), or constitutes a so called VCR-piston that, on one of its sides, is in a direct connection with the combustion chamber of a combustion engine and which, by way of its displacement, is arranged to vary the volume of the combustion chamber, and, thereby, the compression ratio.

As in the preceding embodiments, this device comprises a chamber with a first part 28 and a second part 29. The difference is that the second part 29 is identical with a space in the cylinder 26 on one side of the piston 27 instead of, as in the hydraulic case, being located directly above a substantially thinner valve stem. A valve body 30 forming a slave valve is arranged to open and close a communication between the first part 28 and the second part 29 of the chamber. The motion of the valve body 30 is due to an opening and closing respectively of a communication between the latter and a high pressure source 5 and a low pressure source 6 respectively. An electromagnetically activated valve, here a solenoid-activated slide valve 31, is arranged to open/close the communication between the valve body 30 and the high pressure source 5 and the low pressure source 6 respectively by opening/closing conduits 32, 33 that lead between one side of the valve body 30 and said sources. In other words, the valve body 30 is in directly solenoid-activated, which is included in the general inventive concept. The side of the valve body 30 that is effected by the pressure fluid through the conduits 32 and 33 is sealed against the first part 28 of the chamber, said valve body 30 being arranged, in this case, to be displaced in said first part of the chamber.

A further valve body 34 is arranged to open/close a communication between the second part 29 of the chamber and the low pressure source 6. This valve body 34 is arranged in a way that generally corresponds to that for the first valve body 30. It communicates on one side with the second part 29 of the chamber and on another side with, on one hand, a conduit 35 to the high pressure source, and, on the other hand, a conduit 36 to the low pressure source. The opening and closing respectively of the communication in the conduits 35 and 36 is done by means of the previously mentioned electromagnetically activated valve 31. Moreover, there is a conduit 37 that leads between the first part 28 of the chamber and the high pressure source 5. The electromagnetically activated valve 31 is arranged to open and close the communication also in this conduit. It should be realized that the only electromagnetically activated valve 31 could be replaced by a plurality of electromagnetically activated valves for the accomplishment of opening/closing functions that correspond to the ones that have been described above. However, the device is to operate in accordance with the principals that have already been described in this application and which are generally relevant, independent of embodiment and type of pressure fluid.

Figure 7:
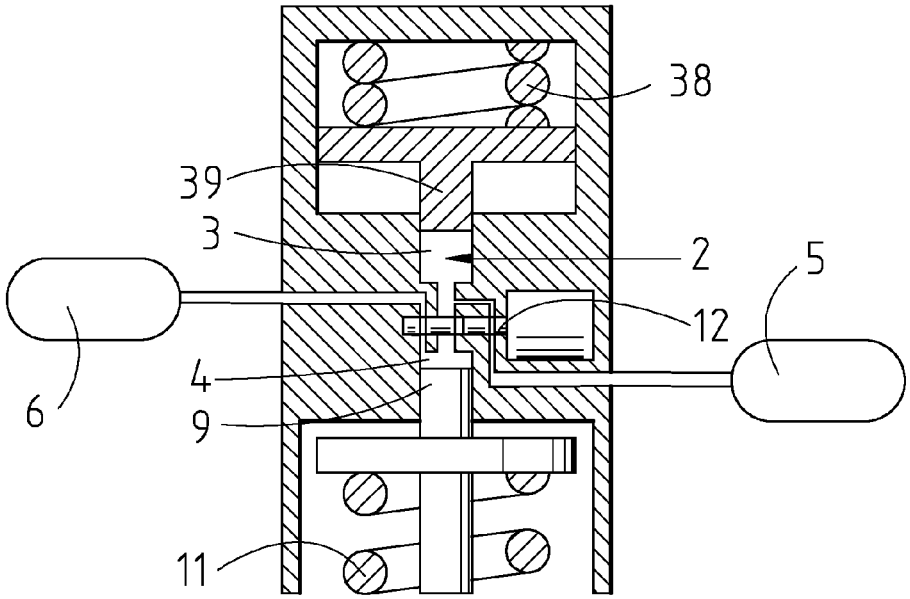
FIG. 7 shows a seventh embodiment of the pressure pulse generator according to the invention.

A further embodiment of a pressure pulse generator according to the invention is shown in FIG. 7. In contrast to the previously described embodiments, this pressure pulse generator comprises a spring 38 that constantly acts with a spring force against a displaceable or elastic wall 39 of the first part 3 of the chamber 2. Here, the spring 38 is of mechanical type, but could, alternatively, be a pneumatic or hydraulic spring.

Although it has not been shown on the figures, it should be realized that electromagnetically activated, preferably solenoid-activated, slide valves are normally provided with a return spring or the like for returning the valve body in question when the activation is discontinued. Of course, it is also possible to have double solenoids, that act pulling and pushing respectively on the valve body and that co-operate for displacing the valve body back and forth between the positions in which the latter opens and interrupts the communication in one or more conduits or connections.

Moreover, pilot valves that are not directly driven by a solenoid, but that are indirectly controlled through a solenoid-activated valve body may replace or supplement anyone of the means that have been described above for the opening/interrupting of the communication between the parts of the chamber or between each individual part and the high pressure source or the low pressure source respectively. Such solutions have to be regarded as being within the scope of the invention.

It should also be mentioned that the pressure pulse transmitting body 9, according to an alternative application, may have as its task to directly act on a fuel for the purpose of causing a direct fuel injection into the combustion chamber of a combustion engine.

It should be mentioned that the body 1 in which the chamber 2 of the pressure pulse generator and the pressure pulse transmitting body 9 are arranged may be the cylinder head of an engine according to the invention. The body 1 may, alternatively, be separate and attached to a cylinder head.

It should be realized that the pressure pulse transmitting body in all implementations of the invention either can be directly connected with, that is forming a part of, the valve body or the VCR-piston that it is to act against, or be separate therefrom.

In the applications that have been discussed above, the fluid pressure, the high pressure, is typically 100-500 bar when the fluid is a liquid, typically oil, and 3-30 bar when the fluid is a gas or a gas mixture, typically air.

It should be realized that the pressure pulse transmitting body constitutes a displaceable wall of the second part 4 of the chamber, whereby the volume of the latter is variable depending on the displacement position of the pressure pulse transmitting body.

The invention claimed is:

1. A method of generating pressure pulses through a pressure pulse transmitting body (9) that is displaceable arranged in a chamber (2), by which the flow of a pressure fluid into and out of said chamber (2) is electromechanically controlled for the purpose of accomplishing pressure changes for the displacement of the pressure pulse transmitting body (9), by a pressure pulse generator that comprises:

said chamber (2), divided into a first and a second parts (3, 4), at least one operable valve body (12) for opening/interrupting a communication between the first and second parts (3, 4) of the chamber, a first conduit (7) that leads between a high pressure source (5) and the first part (3) of the chamber (2), a second conduit (8) that leads between a low pressure source (6) and the second part (4) of the chamber (2), said pressure pulse transmitting body (9) being displaceably arranged in the second part (4) of the chamber (2) and being in contact, on one hand, with the pressure fluid in the chamber (2), and, on the other hand, with an environment and being spring loaded in a direction towards the chamber (2), means for opening/interrupting the communication between the first part (3) of the chamber (2) and the high pressure source (5), and means for opening/interrupting the communication between the second part (4) of the chamber (2) and the low pressure source (6), characterized in that the communication between the high pressure source (5) and the first part (3) of the chamber (2) and the communication between the low pressure source (6) and the second part (4) of the chamber (2) are kept interrupted while the communication between the first and second parts (3, 4) of the chamber (2) is opened and a displacement of the pressure pulse transmitting body (9) out of the chamber (2) is accomplished, and the communication between the first and second parts (3, 4) of the chamber (2) is kept open for a re-establishment of a high pressure in the first part (3) of the chamber (2) while the pressure pulse transmitting body (9), by the spring load, is displaced back towards a retracted start position while the communication between the high pressure source (5) and the first part (3) of the chamber (2) and the communication between the low pressure source (6) and the second part (3) of the chamber (2) are kept interrupted.

2. A method according to claim 1, characterized in that, when said pressure pulse transmitting body (9) is on its way back to or is back in a maximally retracted start position, the communication between the first and second parts (3, 4) of the chamber (2) is interrupted, and the communication between the first part (3) of the chamber (2) and the high pressure source (5) is opened for a total re-establishment of the pressure in the first part (3) of the chamber (2).

3. A method according to claim 1, characterized in that the communication between the first and second parts (3, 4) of the chamber (2) is interrupted, and the communication between the high pressure source (5) and the first part (3) and the communication between the low pressure source (6) and the second part (4) are kept interrupted when said pressure pulse transmitting body (9) has reached a maximally projected position.

4. A method according to claim 3, characterized in that the time period during which the spring loaded inlet or outlet valve (10) is kept in an open position is controlled by a control of the time during which the communication between the first and second part (3, 4) of the chamber (2) is kept interrupted when said pressure pulse transmitting body (9) is in its maximally projected position.

5. A method according to claim 1, characterized in that the communication between the second part (4) of the chamber (2) and the low pressure source (6) is opened while said pressure pulse transmitting body (9) is displaced into the chamber (2) and while the communication between the first part (3) and the second part (4) of the chamber (2) is interrupted or is kept interrupted.

6. A method according to claim 5, characterized in that the communication between the low pressure source (6) and the second part (4) of the chamber (2) is kept opened during a final stage of the returning movement of the pressure pulse transmitting body (9) into the chamber (2), in order to permit the pressure pulse transmitting body (9) to return to a maximally retracted start position.

7. A method according to claim 1, characterized in that the opening/interrupting of the communication between the first and second parts (3, 4) of the chamber (2) is performed electromechanically by means of the operable valve body (12), wherein the operable valve body (12) is a solenoid-activated valve body.

8. A method according to claim 1, characterized in that the opening/interrupting of the communication between the first part (3) of the chamber (2) and the high pressure source (5) is performed electromechanically by means of the operable valve body (12), wherein the operable valve body (12) is a solenoid-activated valve body.

9. A method according to claim 1, characterized in that the opening/interrupting of the communication between the second part (4) of the chamber (2) and the low pressure source is performed electromechanically by means of the operable valve body (12), wherein the operable valve body (12) is a solenoid-activated valve body (12).

10. A method according to claim 1, characterized in that the pressure pulse transmitting body (9) forms or is connected to a spring loaded inlet or outlet valve (10) of a combustion engine, and that the height of lift of the valve (10) is controlled by a control of the pressure that is provided in the first part (3) of the chamber (2) through the high pressure source (5).

11. A pressure pulse generator, comprising:

a pressure pulse transmitting body (9), a chamber (2), divided into a first and a second part (3, 4), a first conduit (7) that leads between a high pressure source (5) and the first part (3) of the chamber (2), a second conduit (8) that leads between a low pressure source (6) and the second part (4) of the chamber (2), said pressure pulse transmitting body (9) being displaceably arranged in the second part (4) of the chamber (2) and being in contact with, on one hand, a pressure fluid in the chamber (2), and, on the other hand, with an environment and being spring loaded in a direction towards the chamber (2), characterized in that it comprises means (26, 27, 12, 13) for opening/interrupting the communication between the first part (3) of the chamber (2) and the high pressure source (5), and means (26, 27, 12, 15) for opening/interrupting the communication between the second part (4) of the chamber (2) and the low pressure source (6), and an operable valve body (12) for opening/interrupting the communication between the first and second parts (3, 4) of the chamber (2).

12. A pressure pulse generator according to claim 11, characterized in that the operable valve body (12) is a solenoid-activated valve body.

13. A pressure pulse generator according to claim 11, characterized in that the means (26, 27, 12, 13) for opening/interrupting the communication between the first part (3) of the chamber (2) and the high pressure source (5) comprises the operable valve body (12), wherein the operable valve body (12) is a solenoid-activated valve body (12).

14. A pressure pulse generator according to claim 11, characterized in that the means (26, 27, 12, 15) for opening/interrupting the communication between the second part (4) of the chamber (2) and the low pressure source (6) comprises the operable valve body (12), wherein the operable valve body (12) is a solenoid-activated valve body (12).

15. A pressure pulse generator according to claim 11, characterized in that the valve body (12), that is used for opening/interrupting the communication between the first and second parts (3, 4) of the chamber (2) also forms a valve body of the means for opening/interrupting the communication between the first part (3) of the chamber (2) and the high pressure source (5).

16. a pressure pulse generator according to claim 11, characterized in that the valve body (12) that is used for opening/interrupting the communication between the first and second parts (3, 4) of the chamber (2) also forms a valve body of the means (26, 27, 12, 15) for opening/interrupting the communication between the second part (4) of the chamber (2) and the low pressure source (6).

17. A pressure pulse generator according to claim 11, characterized in that the means (26, 27, 12, 13) for opening/interrupting the communication between the first part (3) of the chamber (2) and the high pressure source (5) comprise a portion with a reduced circumference or an opening in the pressure pulse transmitting body (9), said portion being positioned in order to permit a communication when said pressure pulse transmitting body (9) is adjacent to or in a start position in which it is maximally retracted into the chamber (2).

18. A pressure pulse generator according to claim 11, characterized in that the means (26, 27, 12, 15) for opening/interrupting the communication between the second part (4) of the chamber (2) and the low pressure source (6) comprise a portion that has a reduced circumference or an opening in the pressure pulse transmitting body (9), said portion being positioned for the purpose of opening for a communication when said pressure pulse transmitting body (9) is closed to or in a start position in which it is maximally retracted into the chamber (2).

19. A pressure pulse generator according to claim 11, characterized in that the first part (3) of the chamber (2) has a volume that is adapted such that the high pressure fluid that is gathered therein is to act as a pressure fluid spring, the triggering of which results in a displacement of the pressure pulse transmitting body (9) from a maximally retracted position to a projected position against the spring load that acts on said pressure pulse transmitting body (9) in an opposite direction.

20. A pressure pulse generator according to claim 11, characterized in that it comprises a control unit with a computer program for controlling the means for opening/interrupting the communication between the first and second parts (3, 4) of the chamber (2) and between the first part (3) of the chamber (2) and the high pressure source (5) and between the second part (4) of the chamber (2) and the low pressure source (6), based upon an information of the position of a piston that operates in the combustion chamber of a piston engine.

21. A piston engine with a valve for an introduction or discharge of air or an air/fuel mixture to a combustion chamber, characterized in that it comprises a pressure pulse generator according to claim 11 for operating said valve.

22. A piston engine with a valve for the variation of the cylinder volume of a combustion chamber in a combustion engine, said piston being arranged displaceably back and forth in a cylinder that is connected with the combustion chamber, characterized in that it comprises a pressure pulse generator according to claim 11 for operating said piston.

* * * * *